US010660408B2

(12) United States Patent
Houng et al.

(10) Patent No.: US 10,660,408 B2
(45) Date of Patent: May 26, 2020

(54) ARTICLE OF FOOTWEAR WITH CLOSURE SYSTEM HAVING A TRANSVERSE FLAP WITH CABLES

(71) Applicant: NIKE, Inc., Beaverton, OR (US)

(72) Inventors: Derek Houng, Portland, OR (US); Benjamin Nethongkome, Beaverton, OR (US); Adam Wassinger, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 192 days.

(21) Appl. No.: 15/947,278

(22) Filed: Apr. 6, 2018

(65) Prior Publication Data

US 2019/0307209 A1 Oct. 10, 2019

(51) Int. Cl.

| | |
|---|---|
| ***A43C 11/20*** | (2006.01) |
| ***A43C 7/02*** | (2006.01) |
| ***A43C 1/06*** | (2006.01) |
| ***A43B 23/02*** | (2006.01) |
| ***A43C 1/04*** | (2006.01) |
| ***A43C 11/00*** | (2006.01) |

(52) U.S. Cl.

CPC ..... *A43C 11/20* (2013.01); *A43B 23/0245* (2013.01); *A43C 1/04* (2013.01); *A43C 1/06* (2013.01); *A43C 7/02* (2013.01); *A43C 11/008* (2013.01)

(58) Field of Classification Search

CPC ..... A43C 11/20; A43C 11/008; A43C 11/08; A43C 1/04; A43C 1/06; A43B 23/0235

USPC ..... 36/50.1

See application file for complete search history.

(56) References Cited

U.S. PATENT DOCUMENTS

| | | | | |
|---|---|---|---|---|
| 1,497,568 | A * | 6/1924 | Kelley | A43C 11/00 36/51 |
| 1,660,664 | A * | 2/1928 | Aleksandrowicz | A43C 11/004 36/50.1 |
| 2,012,188 | A * | 8/1935 | French | A43C 11/008 36/50.1 |
| 2,551,723 | A * | 5/1951 | Camero | A43B 3/126 36/11.5 |
| 3,206,874 | A * | 9/1965 | Ellis | A43B 23/082 36/72 R |
| 3,703,775 | A * | 11/1972 | Gatti | A43B 5/02 36/128 |

(Continued)

FOREIGN PATENT DOCUMENTS

| | | |
|---|---|---|
| DE | 20013472 U1 | 12/2001 |
| GB | 2218684 A | 11/1989 |

*Primary Examiner* — Heather N Mangine
(74) *Attorney, Agent, or Firm* — Quinn IP Law

(57) ABSTRACT

An article of footwear includes an upper having a body with a first side and a second side, and a closure system for the upper. The closure system includes a first anchoring cable loop fixed at the first side, a flap, a flap cable loop, and a lace. The flap is fixed to the second side and extends across the body to a free end at the first side. The flap has an aperture extending through the flap. A flap cable loop extends from the free end. The flap cable loop is configured to extend from the free end through the first anchoring cable loop, and from the first anchoring cable loop back to the flap and through the aperture in the flap from an inner side to an outer side of the flap. A lace extends through the looped end of the flap cable at the outer side.

20 Claims, 6 Drawing Sheets

(56) References Cited

U.S. PATENT DOCUMENTS 4,065,861 A * 1/1978 Pelfrey ..... A43B 5/02 36/133
4,081,916 A * 4/1978 Salisbury ..... A43C 11/008 36/50.1
4,794,674 A * 1/1989 Mintel ..... A43C 11/14 24/712.1
4,901,451 A * 2/1990 Cumin ..... A43B 5/00 36/170
5,463,822 A * 11/1995 Miller ..... A43C 11/00 36/50.1
5,647,104 A * 7/1997 James ..... A43C 11/008 24/68 SK
5,791,021 A * 8/1998 James ..... A43C 1/003 24/68 SK
6,119,372 A * 9/2000 Okajima ..... A43B 5/04 36/117.1
6,267,390 B1 * 7/2001 Maravetz ..... A43B 5/0401 280/14.21
6,681,503 B2 * 1/2004 Morle ..... A43B 5/02 36/133
6,757,991 B2 * 7/2004 Sussmann ..... A43C 11/008 36/50.1
7,428,789 B2 * 9/2008 Holzer ..... A43B 5/0411 36/88
7,490,417 B2 2/2009 Petrie
8,230,560 B2 * 7/2012 Luzlbauer ..... A43C 1/00 24/713.4
8,973,410 B1 * 3/2015 Podhajny ..... A43B 23/024 66/177
9,192,204 B1 * 11/2015 Liles ..... A43B 23/0245
10,327,514 B2 * 6/2019 Rhulen ..... A43C 5/00
2002/0035795 A1 * 3/2002 Smith ..... A43C 11/00 36/50.1
2002/0104233 A1 * 8/2002 Fallon ..... A43B 5/025 36/50.1
2005/0022427 A1 * 2/2005 Kerns ..... A43B 5/14 36/50.1
2007/0068040 A1 * 3/2007 Farys ..... A43C 1/04 36/50.1
2007/0261269 A1 * 11/2007 Petrie ..... A43C 11/008 36/50.1
2008/0201986 A1 * 8/2008 Hentz ..... A43C 11/004 36/50.1
2009/0071041 A1 * 3/2009 Hooper ..... A43B 7/06 36/3 A
2009/0100717 A1 * 4/2009 Cabanis ..... A43B 5/0411 36/116
2009/0217552 A1 * 9/2009 Paintin ..... A43B 1/0054 36/138
2012/0079741 A1 * 4/2012 Kohatsu ..... A43B 3/26 36/50.1
2012/0079746 A1 * 4/2012 Ferreira ..... A43C 1/02 36/105
2013/0008057 A1 * 1/2013 Bird ..... A43B 5/14 36/131
2014/0130372 A1 * 5/2014 Aveni ..... A43B 3/122 36/83
2014/0196317 A1 * 7/2014 Katz ..... A43B 7/20 36/89
2015/0026937 A1 * 1/2015 Nonogawa ..... A43C 1/00 24/713.4
2015/0089839 A1 * 4/2015 James ..... A43B 11/00 36/102
2015/0289595 A1 * 10/2015 Rushbrook ..... A43C 11/22 36/50.1
2016/0058129 A1 * 3/2016 Krueger ..... A43C 1/00 36/114
2016/0206044 A1 * 7/2016 Dimoff ..... A43B 1/04
2016/0255913 A1 * 9/2016 Uchikawa ..... A43B 1/04
2016/0286903 A1 * 10/2016 Whewell ..... A43C 11/20
2016/0331084 A1 * 11/2016 Xanthos ..... A43C 11/008
2017/0027286 A1 * 2/2017 Luedecke ..... A43C 5/00
2017/0105486 A1 * 4/2017 Klein ..... A43B 3/126
2017/0196312 A1 * 7/2017 Xanthos ..... A43B 13/223
2017/0202296 A1 * 7/2017 Fuerst, Jr. ..... A43B 23/027
2017/0202310 A1 * 7/2017 Spanks ..... A43B 3/101
2018/0279721 A1 * 10/2018 Doenges ..... A43C 1/04
2019/0142112 A1 * 5/2019 Ramsay ..... A43B 23/0295 36/50.1

* cited by examiner

ARTICLE OF FOOTWEAR WITH CLOSURE SYSTEM HAVING A TRANSVERSE FLAP WITH CABLES

TECHNICAL FIELD

The present teachings generally include footwear having an upper and a closure system configured for securement of the upper around a foot.

BACKGROUND

Footwear may include a sole structure configured to be located under a wearer's foot to space the foot away from the ground. A footwear upper attached to the sole structure receives the foot. The fit of the upper to the foot may be adjusted with a closure system so that the upper is loose enough to receive the foot but can be tightened around the foot to secure the foot relative to the sole structure. For example, a closure system, such as a lacing system, may include laces that are tied once the foot is received within the upper.

DESCRIPTION

Figure 1:
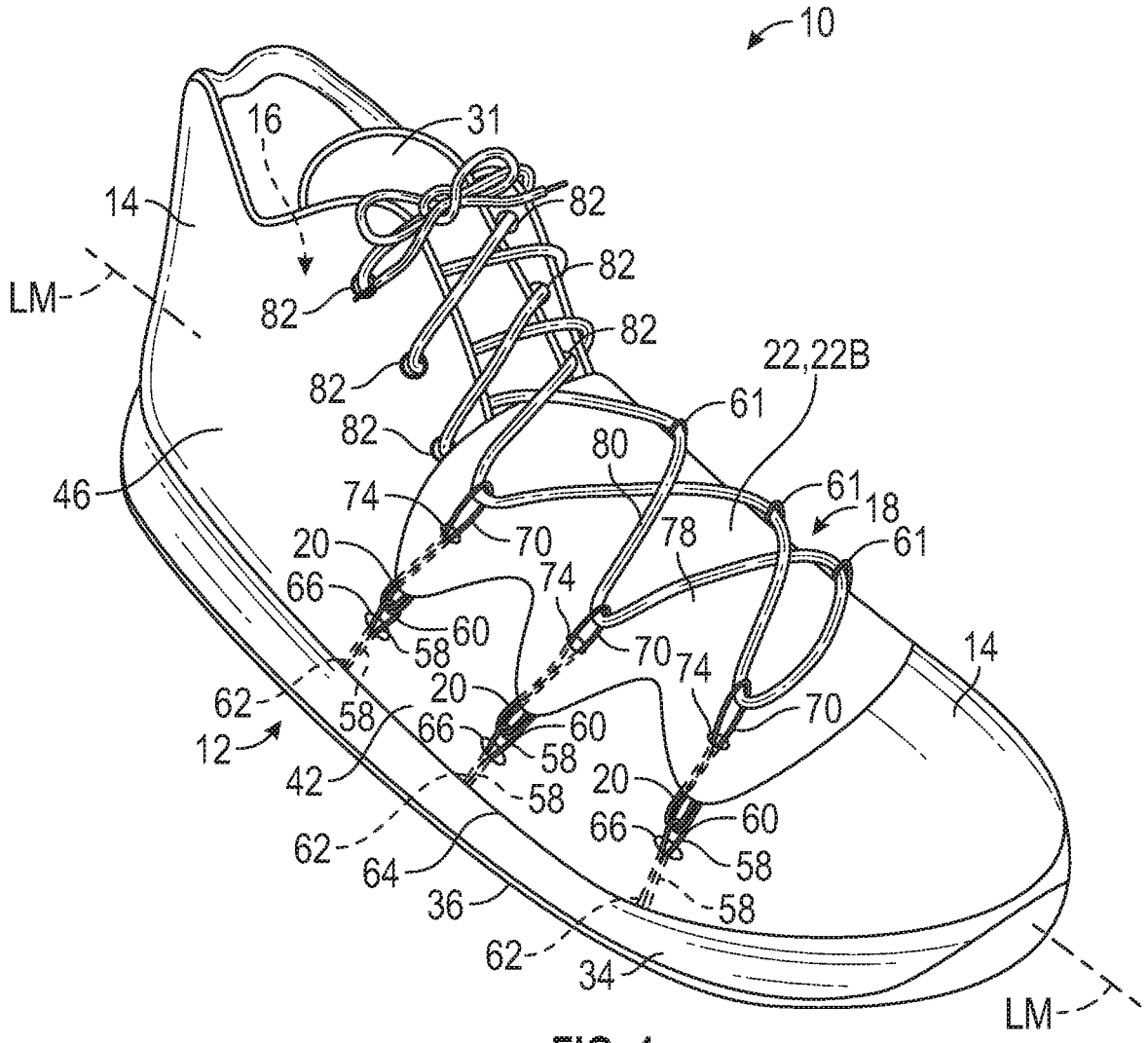
FIG. 1 is a schematic illustration in perspective view showing the lateral side of an article of footwear with a closure system in accordance with the present teachings.

An article of footwear is disclosed that has a closure system with a flap and cable loops that use a pulley action to tighten across the top of the foot as a lace is secured. More specifically, the article of footwear comprises an upper having a body with a first side and a second side, such as a lateral side and a medial side. The article of footwear includes a closure system for the upper. The closure system includes a first anchoring cable loop fixed at the first side of the body. The closure system further includes a flap, a flap cable loop, and lace. The flap is fixed to the second side of the body and is configured to extend across the upper to a free end at the first side of the body. Accordingly, the flap may be referred to as a transverse flap. The flap has an aperture extending through the flap. A flap cable loop extends from the free end of the flap. The flap cable loop is configured to extend from the free end of the flap through the first anchoring cable loop, and from the first anchoring cable loop back to the flap and through the aperture in the flap from an inner side of the flap to an outer side of the flap. A lace extends through the looped end of the flap cable at the outer side of the flap. Pulling the lace slides the flap cable loop through the first anchoring cable loop to tighten the flap against the body of the upper.

The first anchoring cable loop functions similarly to a pulley, and the flap cable loop functions similarly to a pulley cable. The flap cable loop extends downward from the flap to slide through the first anchoring cable loop and doubles back upward toward the flap to extend through the aperture in the flap. The free end of the flap moves closer to the first anchoring cable via the flap cable loop when the lace is pulled, so that the flap is pressed against the body of the upper over the foot-receiving cavity of the upper.

For example, the first side may be a lateral side of the body of the upper, the second side may be a medial side of the body of the upper, and the flap may be fixed to the body of the upper in a midfoot region on the medial side and extend over the upper to the lateral side. The flap may thus provide support to the instep region of a foot. In one or more embodiments, the flap is fixed to the body only on the medial side. In another alternative embodiment, a forward edge of the flap is also fixed to the body between the medial side and the free end at the lateral side.

The flap may be less elastic than the body of the upper so that the tightened flap effectively locks down the body of the upper where it extends across the upper. For example, the body of the upper may be a first material with a first elasticity, and the flap may be a second material with a second elasticity that is less than the first elasticity.

The article of footwear may include a sole structure fixed to the upper. The first anchoring cable loop may extend from the sole structure to the aperture in the body, and extend out of the body of the upper through the aperture in the body. The first anchoring cable loop and the second anchoring cable loop may be fixed to one of the upper and the sole structure. For example, the anchoring cable loops may be secured to a lower end of the upper near a bite line of the footwear, to the sole structure.

In one or more embodiments, the aperture in the flap is a first aperture, and the flap has a second aperture spaced transversely along the flap from the first aperture. The closure system further includes a second anchoring cable loop fixed at the second side of the body of the upper. The second anchoring cable loop is configured to extend through the second aperture. The lace extends through the second anchoring cable loop at the outer side of the flap. Accordingly, the second anchoring cable loop is disposed above the outer surface of the flap to receive the lace.

The first anchoring cable loop may be one of a set of first anchoring cable loops spaced along the first side of the body in a longitudinal direction of the article of footwear. The first aperture in the flap may be one of a set of first apertures spaced apart from one another in the longitudinal direction and each extending through the flap. Similarly, the second anchoring cable loop may be one of a set of second anchoring cable loops spaced along the second side of the body in the longitudinal direction, and each extending through a respective one of the second apertures. The lace may be configured to extend through the each of the second anchoring cable loops at the outer side of the flap.

The flap cable loop may be one of a set of flap cable loops each extending from the free end of the flap and configured to extend through a respective one of the first anchoring cable loops, and then through a respective one of the first apertures in the flap from an inner side of the flap to an outer side of the flap. The lace may be configured to extend through the each of the flap cable loops at the outer side of the flap.

The upper may include one or more eyelets on either side of the upper. For example, the upper may include an eyelet on the first side of the upper disposed rearward of the flap, and an eyelet on the second side of the upper disposed rearward of the flap. Besides extending through the flap cable loops and the second anchoring cable loops, the lace extends through the eyelet on the first side and through the eyelet on the second side.

The free end of the flap may have a plurality of fingers. Each of the flap cable loops may extend from a respective one of the fingers. The fingers may be tapered. The tapered fingers widen away from the flap cable loops, spreading the force exerted by the first anchoring loop on the flap cable loop over the flap to reduce the possibility of concentrated "point" loads. The fingers may also allow the flap to better conform to the shape of the foot at the instep region, in comparison to a flap having a straight edge at the free end.

In some embodiments, the set of first anchoring cable loops may be formed by a single cable routed along the first side, and the set of second anchoring cable loops may be formed by a single cable routed along the second side. Similarly, the flap cable loops may be portions of a single flap cable that extends along an edge of the free end of the flap, forming the flap cable loops. Integrating the cable loops in this manner may reduce the number of components and simplify assembly.

Within the scope of the present disclosure, an article of footwear may comprise an upper, a first set of cable loops extending from a first side of the upper, a second set of cable loops extending from a second side of the upper, and a flap fixed to the second side of the upper. The flap is configured to extend across the upper to a free end at the first side of the upper. The flap has a third set of cable loops extending from the free end. The third set of cable loops is configured to extend from the free end of the flap through the first set of cable loops, and double back to extend through a first set of apertures in the flap from an inner side of the flap to an outer side of the flap. The second set of cable loops is configured to extend through a second set of apertures in the flap. A lace is configured to extend through the first and third sets of cable loops at the outer side of the flap with the flap between the lace and the upper. Tightening the lace tightens the flap against the upper by sliding the third set of cable loops through the first set of cable loops.

The upper may further comprise an eyelet on the first side of the upper disposed rearward of the flap, and an eyelet on the second side of the upper disposed rearward of the flap. The lace extends through the eyelet on the first side and through the eyelet on the second side. An edge of the free end of the flap may have a plurality of fingers spaced apart from one another. Each cable loop of the third set may extend from a respective one of the plurality of fingers. A single cable may extend along the edge of the free end of the flap and form the third set of cable loops. Each of the plurality of fingers may be tapered. The upper may have a body from which the first set of cable loops and the second set of cable loops extends. The body of the upper may be a first material with a first elasticity, and the flap may be a second material with a second elasticity that is less than the first elasticity. The article of footwear may further comprise a sole structure fixed to the upper. The first side may be a lateral side of the upper, the second side may be a medial side of the upper, and the flap may be fixed to the upper in a midfoot region on the medial side and extend over the upper to the lateral side.

The above features and advantages and other features and advantages of the present teachings are readily apparent from the following detailed description of the modes for carrying out the present teachings when taken in connection with the accompanying drawings.

Referring to the drawings, wherein like reference numbers refer to like components, FIG. 1 shows an article of footwear 10 that has a sole structure 12 and an upper 14 secured to the sole structure 12. The upper 14 forms a foot-receiving cavity 16 configured to receive a foot (not shown). The upper 14 is tightened and secured around the foot with a closure system 18 that that uses a flap 22 with flap cables 20 formed into flap cable loops 70 that slide within anchoring cable loops 60 when a lace 80 is pulled to secure the flap 22 over an instep region 30 of the article of footwear 10.

The footwear 10 illustrated herein is depicted as athletic footwear configured for sports such as basketball, but the footwear 10 and closure system 18 are not limited to basketball shoes or other sports shoes. The closure system 18 and other features of the article of footwear 10 may be also be used in footwear for various other sports such as but not limited to running, tennis, football, soccer, etc. or in other types of footwear, such as in an article of footwear that is a leisure shoe, a dress shoe, a work shoe, a sandal, a slipper, a boot, or any other category of footwear.

Figure 2:
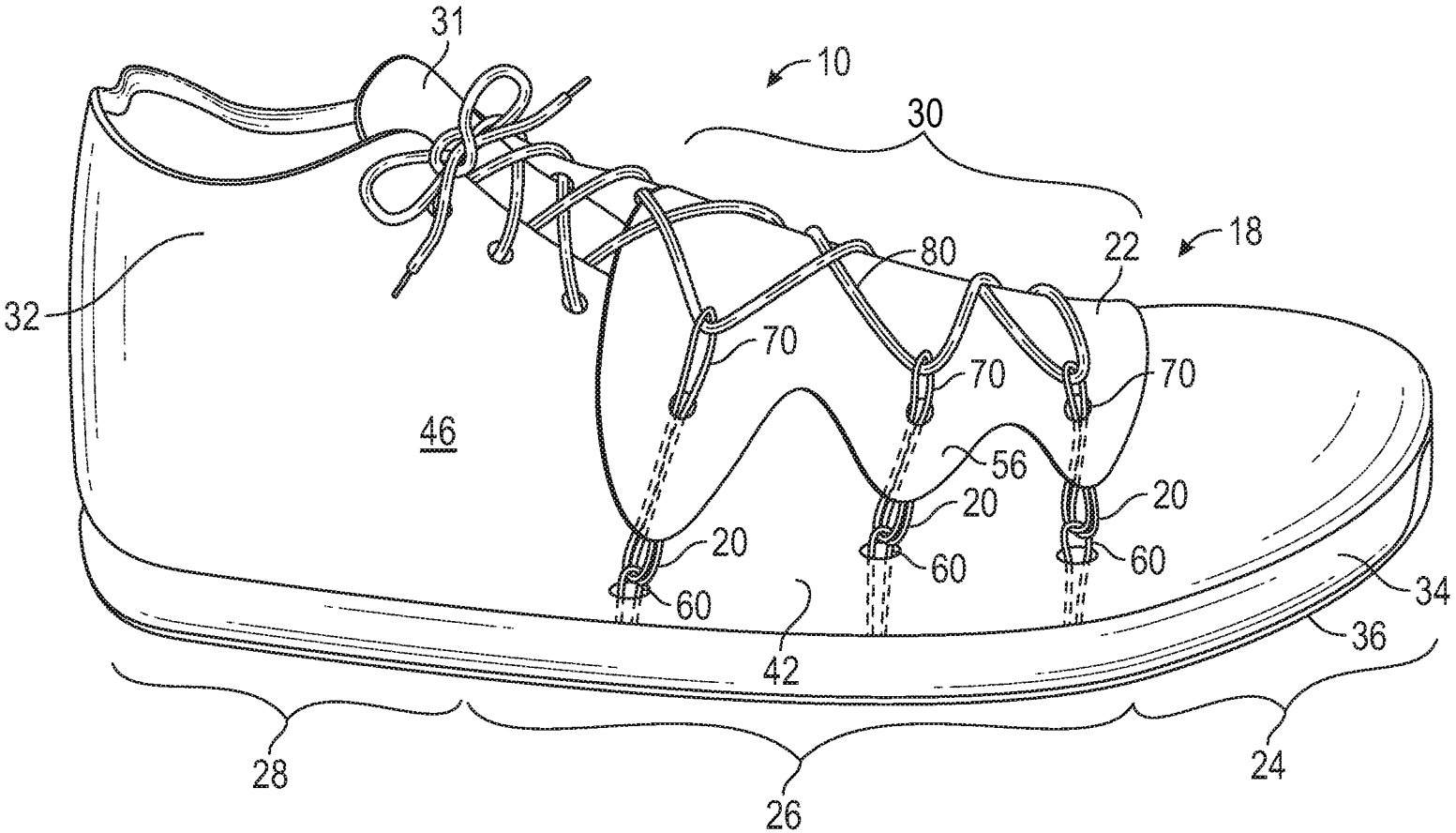
FIG. 2 is a schematic illustration in perspective view of the lateral side of the article of footwear of FIG. 1.

As indicated in FIG. 2, the footwear 10 may be divided into a forefoot region 24, a midfoot region 26, a heel region 28, and an ankle region 32, which are also the forefoot region, the midfoot region, and the heel region, respectively, of the sole structure 12 and the upper 14. The upper 14 also defines an ankle region 32. The forefoot region 24 generally includes portions of the article of footwear 10 corresponding with the toes and the joints connecting the metatarsals with the phalanges. The midfoot region 26 generally includes portions of the article of footwear 10 corresponding with the arch area and instep 30 of the foot, and the heel region 28 corresponds with rear portions of the foot, including the calcaneus bone. The ankle region 32 corresponds with the ankle. The forefoot region 24, the midfoot region 26, the heel region 28, and the ankle region 32 are not intended to demarcate precise areas of the footwear 10, but are instead intended to represent general areas of the footwear 10 to aid in the following discussion.

The sole structure 12 includes a midsole 34 and an outsole 36. The midsole 34 may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, the midsole 34 may incorporate fluid-filled chambers, plates, moderators, or other elements that further attenuate forces, enhance stability, or influence the motions of the foot. The midsole 34 may be a single, one-piece midsole, or could be multiple components integrated as a unit. In some embodiments, the midsole 34 may be integrated with the outsole 36 as a unisole. The outsole 36 may be one-piece, or may be several outsole components, and may be formed from a wear-resistant rubber material that may be textured to impart traction and/or may include traction elements such as cleats secured to the midsole 34.

When the foot is positioned within the foot-receiving cavity 16 of the footwear 10, it is supported on a foot-facing surface of the midsole 34. Optionally, the foot-facing surface of the midsole 34 may be covered by a strobel (not shown) secured to a lower region of the upper 14. Also, optionally, an insole (not shown) may rest on the strobel or directly on the sole structure 12 in embodiments without a strobel, in which case the foot is supported by both the sole structure 12 and the insole.

The footwear 10 has a lateral side 42 (shown in FIGS. 1 and 2), also referred to as a first side, and a medial side 44 (shown in FIG. 4), also referred to as a second side. The lateral side 42 and medial side 44 extend through each of the forefoot region 24, the midfoot region 26, the heel region 28, and the ankle region 32, and correspond with opposite sides of the article of footwear 10, each falling on an opposite side of a longitudinal midline LM of the article of footwear 10, partially indicted in FIG. 1. The medial side 44 is thus considered opposite to the lateral side 42.

The upper 14 may be a variety of materials, such as leather, textiles, polymers, cotton, foam, composites, etc. The upper 14 may include a body 46 of a material that has greater elasticity, greater breathability, or both greater elasticity and greater breathability than the material or materials of the flap 22 in order to aid with foot insertion and comfort. For example, the body 46 may be a polymeric material capable of providing elasticity, and may be of a braided construction, a knitted (e.g., warp-knitted) construction, or a woven construction. A tongue 31 may be integrated with or separately secured to the body 46. For example, the tongue 31 and body 46 could be integral portions of continuous sock upper. The tongue 31 extends over the instep region 30, and is disposed between the foot and the flap 22 at the instep region 30 when the flap 22 is secured.

The flap 22 may be one or more materials and is stiffer than the body 46 to enhance the lockdown effect of the flap 22 over the foot, lending stability to the foot within the upper 14. The flap 22 may be less elastic than the body 46 so that the tightened flap 22 effectively locks down the body 46 where it extends across the upper 14. The body 46 may be a first material with a first elasticity, and the flap 22 may be a second material with a second elasticity that is less than the first elasticity. For example, the flap 22 may be suede, leather, composites, a thermoplastic polyurethane, or the like. The closure system 18 provides an adjustable, secure fit to tighten the body 46 of the upper 14 around the foot, to thereby secure the foot relative to the sole structure 12 underlying the upper 14.

Figure 5:
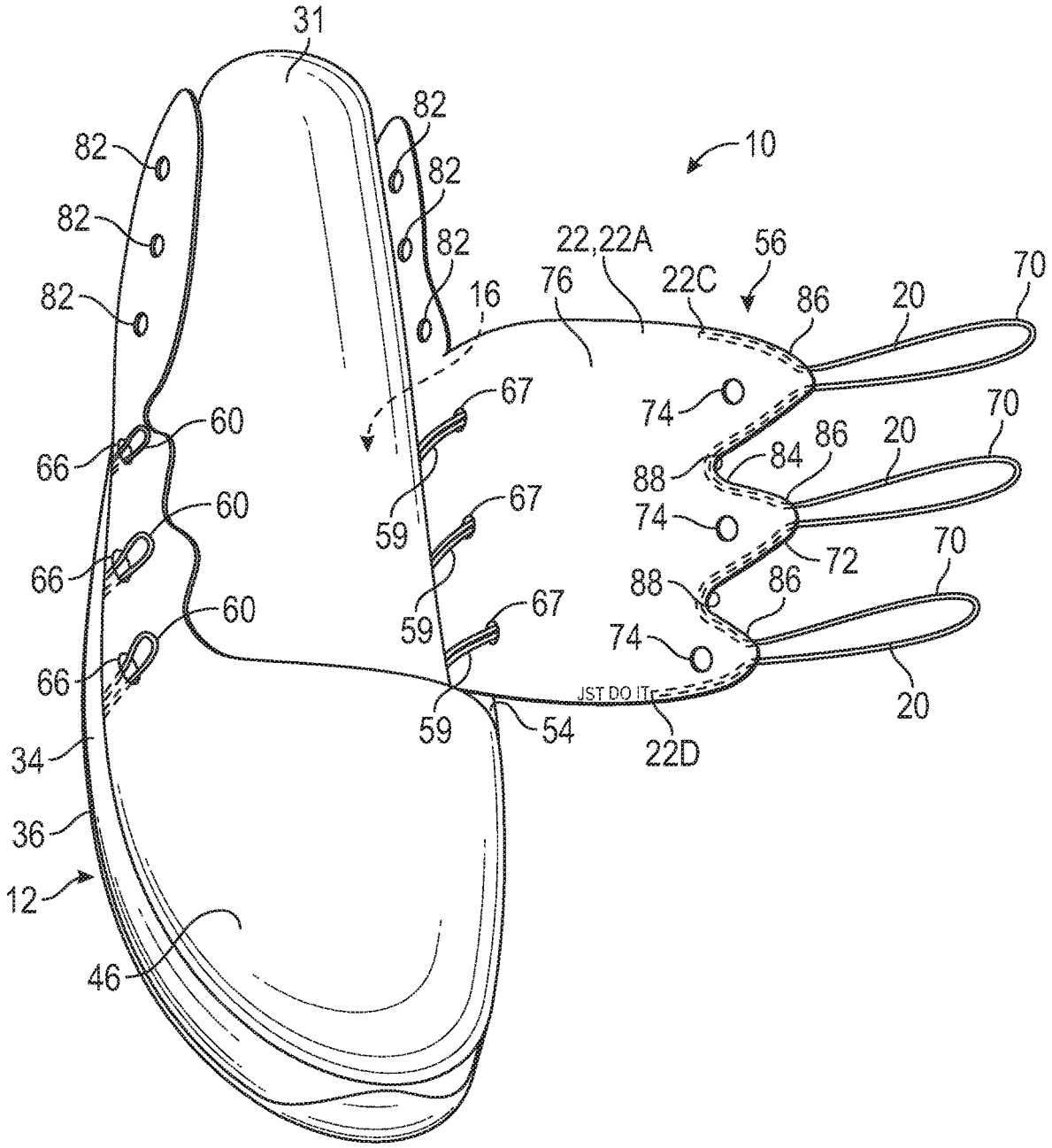
FIG. 5 is a schematic illustration in front view of the article of footwear of FIG. 1.

The flap 22 is fixed to the second side 44 of the upper 14 at a fixed portion 54 of the flap 22 that is integral with or fixedly connected to the body 46 at the second side 44. The flap 22 extends from the fixed portion 54 across the upper 14 (e.g., over the top of the body 46 and the foot therein, at the instep region 30) to a free end 56 at the first side 42 of the upper 14. Accordingly, the flap 22 may be referred to as a transverse flap. The free end 56 of the flap is referred to as a "free" end as it may be moved away from the body 46 if held outward from the upper 14. As used herein, an "end" of a component is not limited to a terminal edge of a component, but instead also includes a portion of the component in the vicinity of the terminal end. In FIG. 5, the flap 22 is shown lifted away from the body 46 at the free end 56. In the use position, when the foot is in the upper 14 with the closure system 18 securing the article of footwear 10 to the foot, the free end 56 is no longer free to be lifted from the body 46 and rests at the first side 42 of the upper 14.

The closure system 18 includes first anchoring cable loops 60, referred to as a first set of cable loops, that are fixed at the first side 42 of the upper 14. In the embodiment shown, a set of first anchoring cable loops 60 are spaced along the first side 42 of the upper 14 in a longitudinal direction (i.e., along the length of the upper 14). In FIG. 1, there are three first anchoring cable loops 60 formed by one or more anchoring cables 58. For example, the cable portions labelled 58 may be a single anchoring cable 58 that also extends between the portions shown along a lower extremity of the body 46, or each cable portion labelled 58 may be a separate cable 58 secured to one of the body 46 or the sole structure 12. In other embodiments, there may be a different number of first anchoring cable loops 60, such as only one first anchoring cable loop 60, two first anchoring cable loops 60, or more than three first anchoring cable loops 60.

The first anchoring cable loops 60 have proximal portions 62 that are fixed to at least one of the body 46 of the upper 14 or the sole structure 12 on the lateral side 42 near the bite line 64 of the article of footwear 10 (i.e., the visible line in FIG. 1 where the upper 14 meets the sole structure 12). The first anchoring cable loops 60 are at least partly disposed either within the body 46 near the bite line 64, or are at least inward of an outer surface of the body 46 until they emerge from apertures 66 in the body 46 to extend outside of the exterior surface of the body 46. For example, between the bite line 64 and the apertures 66, the first anchoring cable loops 60 may be disposed between inner and outer layers of body 46, or may be disposed in channels integrally woven into or secured to the body 46. The securement of the first anchoring cable loops 60 and spacing of the apertures 66 ensures that the first anchoring cable loops 60 do not overlap one another and are spaced apart from one another between their proximal portions 62 and the apertures 66.

The first anchoring cable loops 60 may be U-shaped turns of the first anchoring cable(s) 58, as indicated in FIG. 1. Alternatively, a first anchoring cable loop 60 may be achieved by stitching or tying two portions of the first anchoring cable 58 to one another to form a loop, or by any other means of forming an opening at the end of the cable 58 that can receive a lace.

Figure 4:
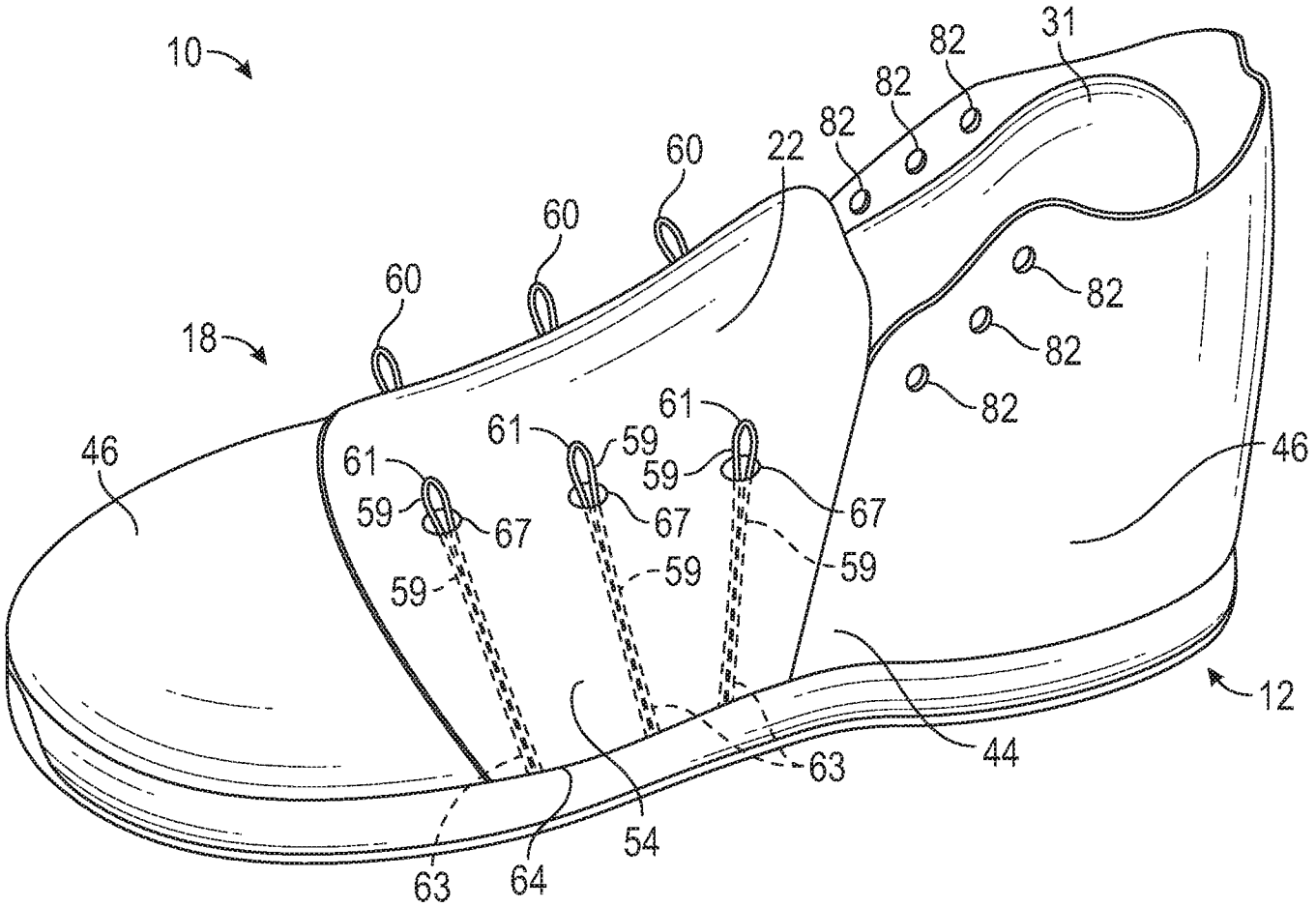
FIG. 4 is a schematic illustration in perspective view showing the medial side of the article of footwear of FIG. 1.

Referring to FIGS. 4 and 5, the closure system 18 further includes second anchoring cable loops 61, referred to as a second set of cable loops, fixed at the second side 44 of the upper 14. In the embodiment shown, a set of second anchoring cable loops 61 are spaced along the second side 44 of the upper 14 in a longitudinal direction (i.e., along the length of the upper 14). In FIG. 4, there are three second anchoring cable loops 61 formed by one or more second anchoring cables 59. For example, the cable portions labelled 59 may be a single second anchoring cable 59 that also extends between the portions shown along a lower extremity of the body 46, or each cable portion labelled 59 may be a separate second anchoring cable 59 secured to one of the body 46 or the sole structure 12. In other embodiments, there may be a different number of second anchoring cable loops 61, such as only one second anchoring cable loop 61, two second anchoring cable loops 61, or more than three second anchoring cable loops 61. The number of second anchoring cable loops 61 is the same as the number of first anchoring cable loops 60.

The second anchoring cable loops 61 have proximal portions 63 that are fixed to at least one of the body 46 of the upper 14, the flap 22, or the sole structure 12 on the medial side 44 near the bite line 64 of the article of footwear 10. The second anchoring cable loops 61 are disposed either within the body 46 or the flap 22 near the bite line 64, or are at least inward of an outer side 78 of the flap 22 until they extend through apertures 67 in the flap 22 and emerge from the apertures 67 to extend outside of the outer side 78 of the flap 22. For example, between the bite line 64 and the apertures 67, the second anchoring cable loops 61 may be disposed between inner and outer layers of body 46 or the flap 22, or may be disposed in channels integrally woven into or secured to the body 46 of the flap 22. In FIG. 5, the second anchoring cable loops 61 are shown inward of the inner side 76 of the flap 22 in the foot-receiving cavity 16 until they extend through the apertures 67 in the flap 22. The securement of the second anchoring cable loops 61 and spacing of the apertures 67 ensures that the second anchoring cable loops 61 do not overlap one another and are spaced apart from one another between their proximal portions 63 and the apertures 67. The apertures 67 in the flap 22 are referred to as second apertures or a second set of apertures in the flap 22.

The second anchoring cable loops 61 may be U-shaped turns of the second anchoring cable(s) 59, as indicated in FIG. 4. Alternatively, a second anchoring cable loop 61 may be achieved by stitching or tying two portions of the second anchoring cable 59 to one another to form a loop, or by any other means of forming an opening at the end of the cable 59 that can receive a lace.

The closure system 18 further includes a flap cable loop 70. A set of flap cable loops 70 are shown in FIG. 1, each extending from the free end 56 of the flap 22, as best shown in FIG. 5. The flap cable loops 70 are referred to as a third set of cable loops, and are formed by U-shaped turns of one or more flap cables 20. For example, a single flap cable 20 is partly disposed between an inner layer 22A (FIG. 5) and an outer layer 22B (FIG. 1) of the flap 22, and extends along an edge 72 of the free end 56 of the flap 22. The flap cable 20 is routed out from between the layers 22A, 22B at the edge 72 to form flap cable loops 70 protruding from the edge 72.

Figure 3:
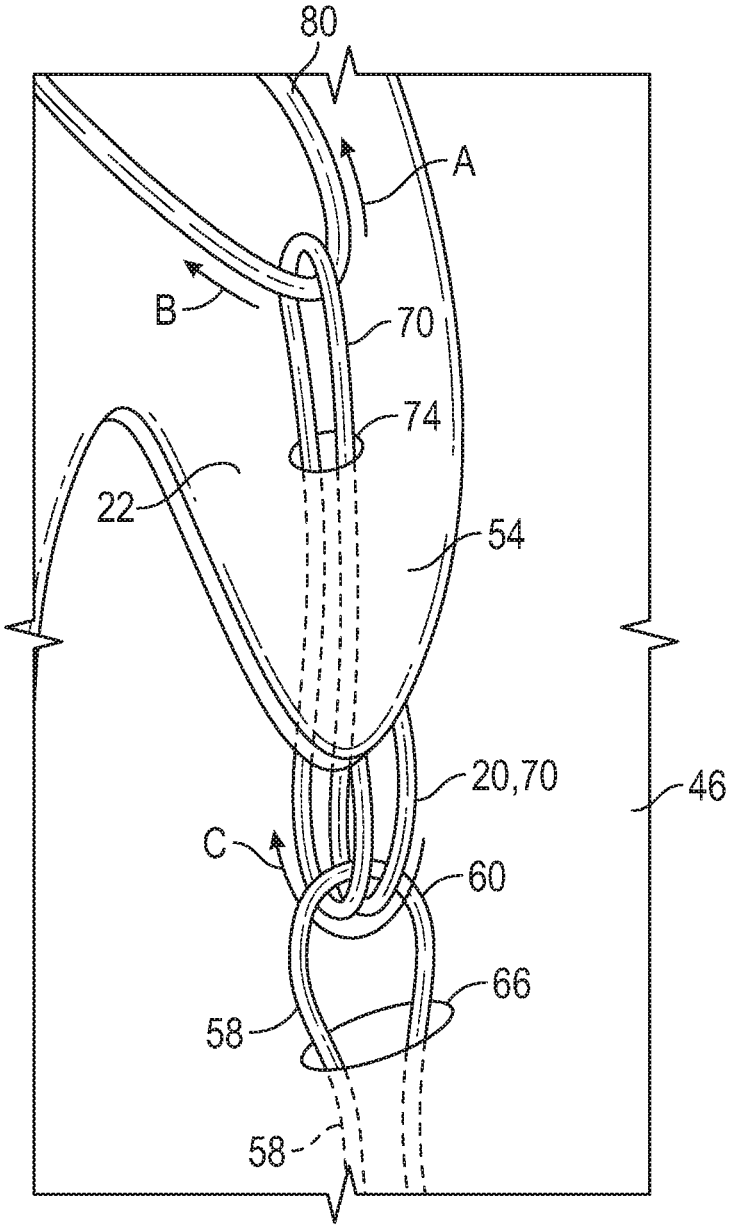
FIG. 3 is a schematic illustration in fragmentary view of all portion of the closure system of the article of footwear of FIG. 1.

The flap 22 has a set of first apertures 74 extending completely through the flap 22 from an inner side 76 of the flap 22 to an outer side 78 of the flap 22. The flap cable loops 70 are configured to extend from the free end 56 through the first anchoring cable loops 60, and then double back toward the flap 22 to extend from the first anchoring cable loop 60 to the flap 22 and through a respective one of the first apertures 74 in the flap 22 from the inner side 76 of the flap to the outer side 78 of the flap 22, emerging outward of the outer side 78. The flap cable loops 70 are configured to be sufficiently long and flexible to be able to extend from the flap 20 and be routed in this manner, doubling back toward, under, and outward of the flap 20 after passing through the first anchoring cable loops 60, as best illustrated in FIG. 3.

The closure system 18 includes a lace 80 that extends through the flap cable loops 70 and through the second anchoring cable loops 61 at the outer side 78 of the flap 22. For example, the lace 80 is shown crisscrossing over the outer side of the flap 22 between the flap cable loops 70 and the second anchoring cable loops 61. Pulling the lace 80 as indicated by force arrows A, B in FIG. 3, causes the flap cable loops 70 to slide through the first anchoring cable loops 60, as indicted by arrow C in FIG. 3, to tighten the flap 22 against the upper 14. Each first anchoring cable loop 60 functions similarly to a pulley, and the flap cable loop 70 sliding through the first anchoring cable loop 60 functions similarly to a pulley cable that pulls the flap 22 downward against the body 46 of the upper 14 and the tongue 31 discussed herein when the lace 80 is tightened. The flap cable loop 70 extends downward from the flap 22 to slide through the first anchoring cable loop 60 and doubles back upward toward the flap 22 to extend through the aperture 74. The free end 56 of the flap 22 moves closer to the first anchoring cable loop 60 via the flap cable loops 70 when the lace 80 is pulled, so that the flap 22 is pressed against the upper 14 over the foot-receiving cavity 16.

As shown in FIG. 1, the lace 80 extends through the second anchoring cable loop 61 of the second anchoring cable 59 at the outer side 78 of the flap 22. Accordingly, the first and second sets of cable loops (first and second anchoring cable loops 60, 61) are disposed above the outer side 78 of the flap 22 to receive the lace 80.

As used herein, a "cable", such as any of the cables 20, 58, 59, and a "cable loop", such as any of the cable loops 60, 61, 70, is a flexible, elongated tensile element, and is a structure capable of withstanding a tensile load and includes, but is not limited to, a lace, a strand, a wire, a cord, a thread, or a string, among others. The cables and cable loops may be located to (a) resist stretching of the upper in specific directions or locations, (b) limit excess movement of the foot relative to the sole structure 12 and the upper 14, (c) ensure that the foot remains properly positioned relative to the sole structure 12 and the upper 14, and/or (d) reinforce locations where forces are concentrated. As non-limiting examples, suitable materials for the cables and cable loops formed by the cables include various filaments, fibers, yarns, threads, or ropes that are formed from rayon, polyamide, polyester, polyacrylic, silk, cotton, carbon, glass, aramids (e.g., para-aramid fibers and meta-aramid fibers), ultra-high molecular weight polyethylene, liquid crystal polymer, copper, aluminum, or steel.

The upper 14 may further include one or more eyelets 82 on either side of the upper 14. For example, the upper may include one or more eyelets 82 on the first side 42 of the upper and disposed rearward of the flap 22, and an eyelet 82 on the second side 44 of the upper 14 and disposed rearward of the flap 22. After being routed through the flap cable loops 70 and the second anchoring cable loops 61, the lace 80 extends through the eyelets 82. The eyelets 82 may be simply apertures in the upper 14, or may include reinforcing features or separate lace-receiving elements secured to the upper 14.

The flap 22 may have one or more features that help it to conform to the shape of the instep 30 and to disperse the tensioning forces of the flap cable loops 70 over the flap 22 to reduce or eliminate concentrated point loading. For example, as shown in FIG. 5, an edge 84 of the free end 56 of the flap 22 has a plurality of fingers 86 spaced apart from one another by notches 88. Each flap cable loop 70 extends from a respective one of the fingers 86. The fingers 86 taper toward their extremities from which the flap cable loops 70 extend. For example, the fingers 86 may be generally triangular, with rounded extremities as shown, or with pointed extremities. Each of the tapered fingers 86 widens in a direction away from the attached flap cable loop 70, which may help to spread the tension exerted by the cable loop 70 on the extremity of the finger 86 over the flap 22. The tapered fingers 86 widen away from the flap cable loops 70, spreading the force exerted by the first anchoring loop 60 on the flap cable loop 70 over the flap 22 to reduce the possibility of concentrated "point" loads. The fingers 86 may also allow the flap 22 to better conform to the shape of the foot at the instep region 30, in comparison to a flap 22 having a straight edge at the free end 56.

As shown in FIG. 5, the flap cable loops 70 may each be formed by (i.e., portions of) a single flap cable 20. The single flap cable 20 is routed to extend along the edge 72 of the free end 56 of the flap 22 between a first end 22C of the single flap cable 20 and a second end 22D of the single flap cable 20. State differently, the single flap cable 20 is disposed between inner and outer layers of the flap 22 and is routed in a serpentine fashion to track the edge 72, extending out from between the inner and outer layers at the extremities of the fingers 86 to form a U-shaped turn that serves as a flap cable loop 70 at each of the fingers 86.

Figure 6:
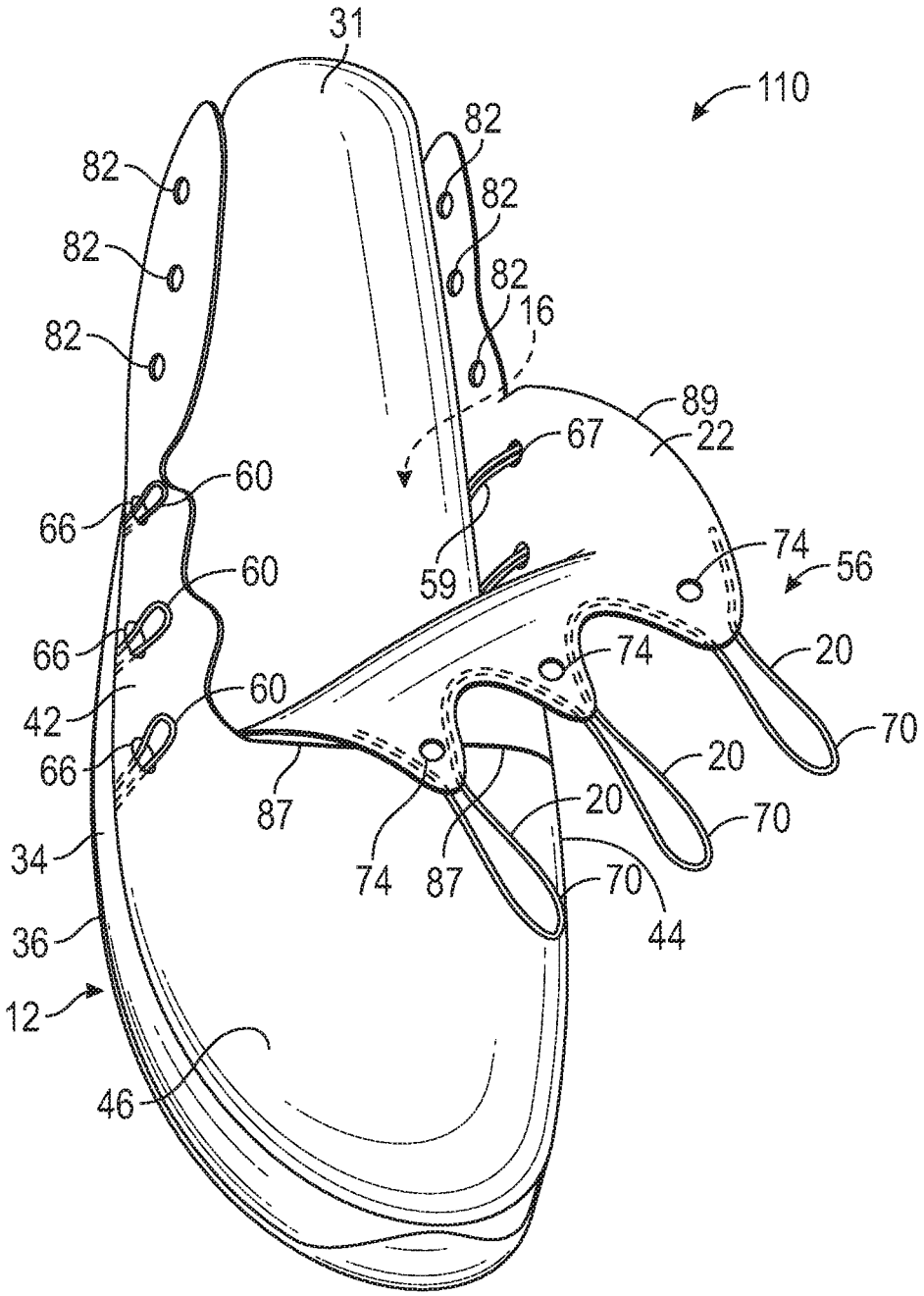
FIG. 6 is a schematic illustration in front view of an alternative article of footwear with a closure system in accordance with the present teachings.

In FIG. 5, the flap 22 is fixed only to the second side 44 of the upper 14 at a fixed portion 54 of the flap 22 that is integral with or fixedly connected to the body 46 at the second side 44. Stated differently, the fixed portion 54 of the flap 22 is only on the medial side 44, and a forward edge 87 as well as a rear edge 89 of the flap 22 are not fixed to the body 46 and may be moved away from the body 46 when the lace 80 is removed and the free end 56 is lifted as shown. Another alternative embodiment of an article of footwear 110 is shown in FIG. 6. The article of footwear 110 is alike in all aspects and has all of the features and functions described with respect to the article of footwear 10, except that the forward edge 87 of the flap 22 is also fixed to the body 46 between the medial side 44 and the lateral side 42. Stated differently, the fixed portion 54 of the flap 22 is on the medial side 44, but also includes the forward edge 87 of the flap 22. In FIG. 6, the article of footwear 110 is shown with the lace 80 removed and the flap 22 lifted, similarly as in the article of footwear 10 of FIG. 5. Because the forward edge 87 is fixed, the flap 22 does not lift as far from the body 46, and is shown folded slightly over itself forward and toward the medial side 44.

To assist and clarify the subsequent description of various embodiments, various terms are defined herein. Unless otherwise indicated, the following definitions apply throughout this specification (including the claims).

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal", as used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse", as used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical", as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" shall refer to the direction toward the interior of the component or article of footwear, such as a shoe, and the terms "outward" and "outwardly" shall refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

an upper having a body with a first side and a second side;

a closure system for the upper including a first anchoring cable loop fixed at the first side of the body;

a flap fixed to the second side of the body and configured to extend across the upper to a free end at the first side of the body; wherein the flap has an aperture extending through the flap;

a flap cable loop extending from the free end of the flap, the flap cable loop extends from the free end of the flap through the first anchoring cable loop, and from the first anchoring cable loop back to the flap and through the aperture in the flap from an inner side of the flap to an outer side of the flap; and a lace extending through the flap cable loop at the outer side of the flap, wherein pulling the lace slides the flap cable loop through the first anchoring cable loop to tighten the flap against the body of the upper.

2. The article of footwear of claim 1, wherein the aperture in the flap is a first aperture, and the flap has a second aperture spaced transversely along the flap from the first aperture, and the closure system further including:

a second anchoring cable loop fixed at the second side of the body and configured to extend through the second aperture; wherein the lace extends through the second anchoring cable loop at the outer side of the flap.

3. The article of footwear of claim 2, further comprising:

a sole structure fixed to the upper; wherein the body of the upper has an aperture, and the first anchoring cable loop extends from the sole structure to the aperture in the body, and extends out of the body of the upper through the aperture in the body.

4. The article of footwear of claim 2 wherein:

the first anchoring cable loop is one of a set of first anchoring cable loops spaced along the first side of the body in a longitudinal direction of the article of footwear; and the first aperture in the flap is one of a set of first apertures spaced apart from one another in the longitudinal direction and each extending through the flap.

5. The article of footwear of claim 4, wherein:

the second aperture in the flap is one of a set of second apertures spaced apart from one another in the longitudinal direction and each extending through the flap;

the second anchoring cable loop is one of a set of second anchoring cable loops spaced along the second side of the body in the longitudinal direction, and each extending through a respective one of the second apertures; and the lace is configured to extend through the each of the second anchoring cable loops at the outer side of the flap.

6. The article of footwear of claim 4, wherein the flap cable loop is one of a set of flap cable loops each extending from the free end of the flap and configured to extend through a respective one of the first anchoring cable loops, and then through a respective one of the first apertures in the flap from the inner side of the flap to the outer side of the flap; and the lace is configured to extend through the each of the flap cable loops at the outer side of the flap.

7. The article of footwear of claim 1, wherein the upper further comprises: an eyelet on the first side of the body of the upper and disposed rearward of the flap; and an eyelet on the second side of the body of the upper and disposed rearward of the flap; wherein the lace is configured to extend through the eyelet on the first side and through the eyelet on the second side.

8. The article of footwear of claim 7, wherein the upper further includes a tongue disposed between the first side and the second side of the body and configured to extend under the flap when the flap is tightened against the body of the upper.

9. The article of footwear of claim 1, wherein:

the flap cable loop is one of a set of flap cable loops each extending from the free end of the flap;

the free end of the flap has a plurality of fingers; and each of the flap cable loops extends from a respective one of the fingers.

10. The article of footwear of claim 9, wherein the flap cable loops are portions of a single flap cable that extends along an edge of the free end of the flap.

11. The article of footwear of claim 9, wherein the fingers are tapered.

12. The article of footwear of claim 1, wherein the first side is a lateral side of the body of the upper, the second side is a medial side of the body of the upper, and the flap is fixed to the upper in a midfoot region on the medial side and extends over the upper to the lateral side.

13. The article of footwear of claim 12, wherein a forward edge of the flap is fixed to the body between the first side and the second side.

14. The article of footwear of claim 1, wherein the body of the upper is a first material with a first elasticity, and the flap is a second material with a second elasticity that is less than the first elasticity.

15. An article of footwear comprising:

an upper;

a first set of cable loops extending from a first side of the upper;

a second set of cable loops extending from a second side of the upper;

a flap fixed to the second side of the upper and configured to extend across the upper to a free end at the first side of the upper;

wherein the flap has a third set of cable loops extends from the free end;

wherein the third set of cable loops extends from the free end of the flap through the first set of cable loops and doubles back to extend through a first set of apertures in the flap from an inner side of the flap to an outer side of the flap;

wherein the second set of cable loops extends through a second set of apertures in the flap; and a lace extending through the first and third sets of cable loops at the outer side of the flap with the flap between the lace and the upper, tightening of the lace tightens the flap against the upper by sliding the third set of cable loops through the first set of cable loops.

16. The article of footwear of claim 15, wherein the upper further comprises:

an eyelet on the first side of the upper disposed rearward of the flap; and an eyelet on the second side of the upper disposed rearward of the flap;

wherein the lace extends through the eyelet on the first side and through the eyelet on the second side.

17. The article of footwear of claim 16, wherein:

an edge of the free end of the flap has a plurality of fingers spaced apart from one another; and each cable loop of the third set of cable loops extends from a respective one of the plurality of fingers.

18. The article of footwear of claim 17, wherein a single cable extends along the edge of the free end of the flap and forms the third set of cable loops.

19. The article of footwear of claim 15, wherein:

the upper has a body from which the first set of cable loops and the second set of cable loops extend;

the body of the upper is a first material with a first elasticity; and the flap is a second material with a second elasticity that is less than the first elasticity.

20. The article of footwear of claim 15, further comprising:

a sole structure fixed to the upper;

wherein the first side is a lateral side of the upper, the second side is a medial side of the upper, and the flap is fixed to the upper in a midfoot region on the medial side and extends over the upper to the lateral side.

* * * * *